United States Patent [19]

Bunning

[11] Patent Number: 4,565,113

[45] Date of Patent: Jan. 21, 1986

[54] AUTOMATIC WEAPON CHARGING HANDLE AND BOLT LATCH

[75] Inventor: Ernst Bunning, Durham, N.H.

[73] Assignee: Maremont Corporation, Carol Stream, Ill.

[21] Appl. No.: 593,481

[22] Filed: Mar. 26, 1984

[51] Int. Cl.[4] ..... F41D 11/00; F41F 19/16

[52] U.S. Cl. ..... 89/1.4

[58] Field of Search ..... 89/1.4, 187, 181, 197

[56] References Cited

U.S. PATENT DOCUMENTS 2,101,086 12/1937 Moore ..... 89/1.4 X
3,255,667 6/1966 Walther ..... 89/1.4
3,323,418 6/1967 Löffler ..... 89/1.4 X
3,386,336 6/1968 Roy ..... 89/1.4 X

*Primary Examiner*—David H. Brown
*Attorney, Agent, or Firm*—Allegretti, Newitt, Witcoff & McAndrews, Ltd.

[57] ABSTRACT

An automatic weapon includes a combination charging handle and bolt latch. A grip on a spindle of the handle is spring biased to be unlatched, and latchable by sliding movement toward the bolt receiver of the gun, where a latch member of the grip is wedged between bosses on the receiver. Slight rearward motion of the handle frees the latch member from the bosses, and the spring then swiftly unlatches the grip.

6 Claims, 7 Drawing Figures

AUTOMATIC WEAPON CHARGING HANDLE AND BOLT LATCH

BACKGROUND OF THE INVENTION

This invention relates to automatic weapons, and more particularly, to the charging handle and bolt latches of machine guns.

Automatic weapons such as machine guns have long been known, and have included both charging handles and bolt latches. The charging handles charge the weapons by manual movement of the weapon bolts, and the bolt latches latch the weapons against inadvertant firing by manual locking of the bolts. Construction of such handles and latches has long been dictated by such considerations as lightness of weight of the weapon, quickness of charging action, and security of the latching of the bolt.

Despite the advantages of known automatic weapons, an unsatisfactorily met consideration in an automatic weapon is the quickness of unlatching of the bolt. This consideration is most significant because it is highly desirable that an automatic weapon be kept in a safe condition, because of its destructive potential. At the same time, many situations require hair-trigger responsiveness in the firing of the weapon. Thus, a need has existed for a weapon which may be securely latched in a safe condition, and yet swiftly unlatched to firing readiness.

SUMMARY OF THE INVENTION

The invention of this specification is, in principal part, a response to the stated need for an improved automatic weapon.

Thus, an object of the inventors in making this invention was to provide a weapon which is capable of being securely located in a safe condition, and yet capable of being swiftly unlatched to firing readiness.

In summary, then, the invention is an automatic weapon having a bolt mechanism inside a bolt receiver which includes a charging handle slot. The weapon further includes a combination charging handle and bolt latch. A grip of the handle includes a male latch member, and is mounted on a handle spindle. The spindle is attached to the bolt mechanism through the handle slot, and the grip of the handle is normally biased by a spring away from the bolt receiver, to an unlatched position of the handle, against a grip stop provided on the spindle. A female latch member is on the receiver. The handle may be latched by movement of the grip toward the bolt receiver, against the tension of the spring, to place the male latch member within the female latch member. The handle may be unlatched by slight movement of the grip, which releases the male latch member and permits the spring to swiftly return the grip to the unlatched position.

A more formal, precise description of the invention of this specification is provided by the claims, which conclude this specification, and a more detailed exposition of the features, objects and advantages of the invention is provided by the detailed description of the preferred embodiment, which follows.

DETAILED DESCRIPTION OF THE PREFERRED EMBODIMENT

Figure 1:
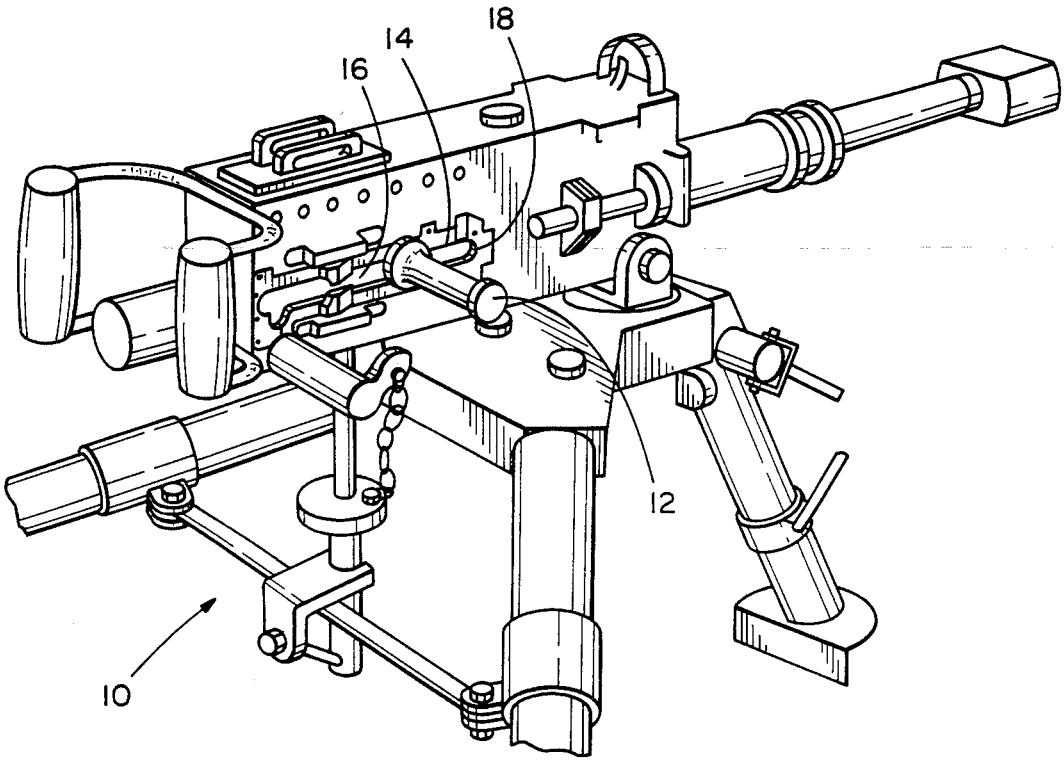
FIG. 1 is a perspective view of the preferred automatic weapon of this invention, which is an improved M-2 machine gun.

Referring to FIG. 1, the preferred automatic weapon is an M-2 lightweight machine gun 10 including a variety of typical components, and also including the improved charging handle and bolt latch components of this invention.

A combination charging handle and bolt latch 12 (hereafter "the charging handle" or "handle" 12) extends from a slot 14 in the gun 10. The handle 12 extends perpendicular, or transverse, to the longitudinal extent and firing direction of the gun. The slot 14 extends longitudinally of the gun 10. The charging handle 12 is manually graspable, and pulled longitudinally rearward to charge the gun 10. Charging is accomplished because the charging handle 12 is attached to a bolt retracting slide 15 and thereby intermittently to the gun bolt 16. The bolt 16 and slide 15 are components of a bolt mechanism, and are slidably movable inside the bolt receiver and retracting slide bracket 18 of the gun.

Figure 2:
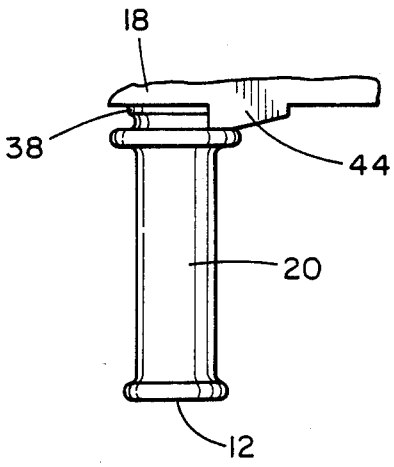
FIG. 2 is a plan view of the preferred combination charging handle and bolt latch (hereafter "the preferred handle") of the invention in a latched condition.
Figure 3:
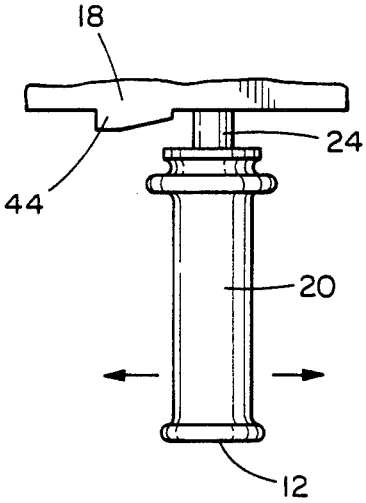
FIG. 3 is a plan view of the preferred handle of the invention in an unlatched condition.

During movement of the charging handle 12, as in the positions of FIGS. 1 and 3, the handle is not latched, and does not prevent weapon discharge. In a latched position of the handle 12, in contrast, the handle is latched against weapon discharge. As shown in FIG. 2, the handle 12 is latched against the bracket 18 of the bolt receiver, and as shown in FIG. 3, the handle 12, when unlatched, is free of the receiver.

Figure 4:
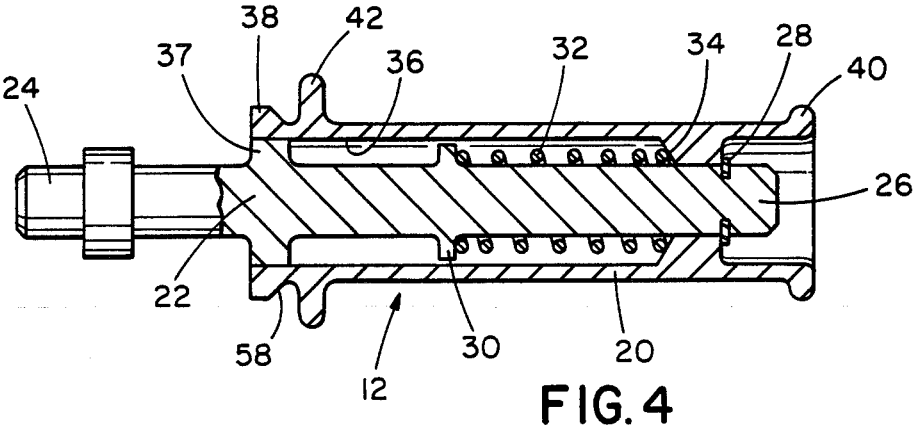
FIG. 4 is a central cross-section view of the preferred handle.
Figure 7:
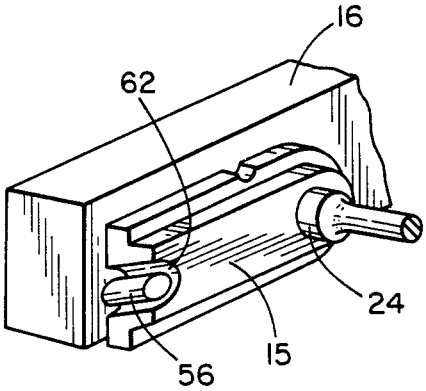
FIG. 7 is a perspective view of the preferred handle and preferred slide bracket of the invention.

Referring to FIG. 4, the charging handle 12 includes a hollow, outer hand grip 20 and an internal spindle 22. Referring to FIG. 7, a first end 24 of the spindle 22 is screwed or otherwise attached to a retracting slide 15. Returning to FIG. 4, at an opposite second end 26, the spindle 22 has a grip stop such as a retaining ring 28. An outwardly enlarged and annular first spring end flange 30 is a part of the spindle 22, between the first end 24 and the retaining ring 28. An end of a compression spring 32 rests against the flange 30, to the side of the flange nearer the second spindle end 26. The spring 32 also rests against a second spring end flange 34, which extends inwardly of the grip cylindrical interior surface 36, between the first spring end flange 30 and the retaining ring 28.

The spring 32 is in compression, and pushes the second spring end flange 34 against the retaining ring 28. The hand grip 20 is thereby held in the position shown in FIG. 3, away from the bracket of the bolt receiver. The spring rate of the spring 32 is adapted such that the force of the spring may be manually overcome. The hand grip 20 is thereby manually movable to the position of FIG. 2, against the bracket 18. The grip 20 is movable by sliding motion along the spindle 22, with the flange 34 and an annular grip guide 37 of the spindle guiding such movement.

Referring again to FIG. 4, the handle 12 further includes an outwardly extending, annular latch member 38. As most preferred, this member 38 is integrally formed or molded in the outer surface of the grip 20. The member 38 is at the bolt receiver end of the grip 20. The member 38 includes a sloped surface 58. Two outwardly extending, annular hand guards 40, 42 complete the grip 20. The guard 40 is molded in the outer end of the grip 20, and the guard 42 is formed at the inner end, adjacent the latch member 38. The guards 40, 42 aid against slipping of the hand from the grip 20.

Figure 5:
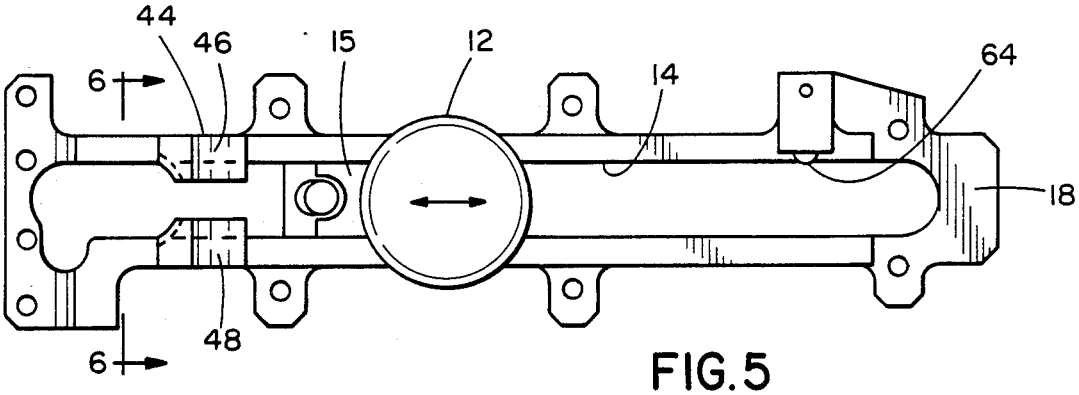
FIG. 5 is a side view of the preferred handle, and of the preferred retracting slide bracket of the invention, which is a part of the receiver of the gun of FIG. 1, with the handle in a position of motion.
Figure 6:
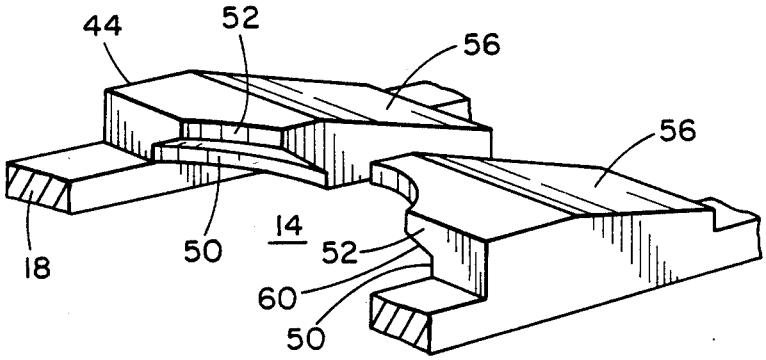
FIG. 6 is a perspective view of the latch member of the preferred retracting slide bracket, as seen generally from direction 6—6 in FIG. 5.

The latch member 38 on the grip 20 cooperates with a latch member 44 on the bracket 18 of the receiver. As shown best in FIGS. 5 and 6, the latch member 44 is formed along the slot 14. The latch member 44 is located along the bracket 18 of the bolt receiver where the handle 12 is located when retracted. The latch member 44 includes two bosses 46, 48 opposite each other across the slot 14. Each boss 46, 48 has an arcuate groove 50, which is concave toward the rear and centerline of the bracket 18 of the bolt receiver, and has an arc of radius equal to the radius of the outer surface of the grip latch member 38. A ledge 52 is above the groove 50, and a cam surface 56 slopes from the ledge 52 to the front of the bosses 46, 48. A sloped surface 60 slopes from the ledge 52 to the groove 50.

As in FIG. 2, the bosses 46, 48 are adapted to capture the grip latch member 38 in the grooves 50 when the handle 20 is the rearward position, and the grip 20 is pushed inward along the spindle 22. When the latch member 38 is so captured, the ledges 52 hold the grip inward, against the force of the spring 32. The handle 12 is thereby latched to the bracket 18 of the bolt receiver.

The sloped surface 58 on the latch member 38 and the sloped surfaces 60 on the bosses 46, 48 mate to wedge the latch members 38, 44 tightly together. The handle 12 holds the retracting slide 15, which, through interaction of a bolt pin 56 and a slide slot 62, as best shown in FIG. 7, holds the bolt 16.

When the handle 12 is to be unlatched, the handle 12 is pulled slightly rearward. The latch member 38 clears the ledges 52, and all substantial resistance to the spring 32 is eliminated. The spring 32 swiftly drives the grip 20 to the unlatched position of FIG. 3. The handle 12 then remains in the unlatched position, until latching is desired.

With the handle 12 unlatched, the slide 15 and bolt 16 are released. The bolt 16 drives the slide 15 and handle 12 forward. The handle 12 remains forward until manually retracted by the action of a detent 64, in FIG. 5.

The preferred embodiment of the invention is now described. This preferred embodiment constitutes the best mode contemplated by the inventor of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventor regards as his invention and wishes to protect.

I claim:

1. An automatic weapon comprising:

a bolt receiver including a charging handle slot and a first latch member;

a bolt mechanism received by the bolt receiver; and a combination charging handle and bolt latch (hereinafter "the charging handle") having a spindle attached to the bolt mechanism through the charging handle slot, a grip including a second latch member, the grip being on the spindle, and bias means for biasing the grip normally away from the bolt receiver, the handle being latchable by movement of the grip toward the bolt receiver against the bias of the bias means, to place the latch members in a bolt latching condition, and the handle being unlatchable by slight movement of the grip which releases the latch members from each other and permits the bias means to swiftly return the grip away from the bolt receiver and in which the length of the weapon defines a longitudinal direction along the length and transverse directions perpendicular to the longitudinal direction, the charging handle slot extending longitudinally, the spindle and grip extending transversely, and the first latch member on the bolt receiver being longitudinally forward of the second latch member in the bolt latching condition, the handle being unlatchable by slight longitudinally rearward movement of the grip.

2. An automatic weapon as in claim 1 in which the first latch member is a female latch member and the second latch member is a male latch member.

3. An automatic weapon as in claim 1 in which the charging handle spindle includes a grip stop and the bias means biases the grip against the grip stop.

4. An automatic weapon as in claim 1 in which the bias means is a compression spring.

5. An automatic weapon comprising: – a bolt receiver including a slide bracket, a charging handle slot and a first latch member, the first latch member being formed on the slide bracket along the charging handle slot and including two bosses opposite each other across the charging handle slot, each boss having an arcuate, concave groove with an arc of a radius, and a ledge above the groove;

a bolt mechanism received by the bolt receiver; and a combination charging handle and bolt latch (hereinafter "the charging handle") having (a) an internal spindle with (i) a first end attached to the bolt mechanism through the charging handle slot, (ii) a grip guide adjacent the first end, (iii) a second end having a grip stop, (iv) a first spring end flange between the first end and the grip stop, (b) an outer hand grip mounted on the internal spindle for sliding movement along the internal spindle including (i) a bolt receiver end, (ii) cylindrical interior surface, (iii) a second spring end flange which extends inwardly of the grip cylindrical interior surface between the first spring end flange and the grip stop, the sliding movement of the hand grip being guided by the second spring end flange and the grip guide and limited by movement of the second spring end flange between the first spring end flange and the grip stop, and (iv) an outwardly extending, annular, second latch member on the grip at the bolt receiver end of the grip, the second latch member having a radius substantially equal to the radius of the arc of the arcuate, concave groove of the bosses, and (c) a compression spring in compression between the first spring end flange and the second spring end flange which biases the second spring end flange toward the grip stop and thereby biases the hand grip away from the bolt receiver, the spring having a spring rate such that the force of the spring may be manually overcome, the hand grip thereby manually moved toward the bolt receiver, the second latch member captured by the bosses, and the handle thereby latched when desired to the bolt receiver.

6. An automatic weapon as in claim 1 in which the length of the weapon defines a longitudinal direction along the length and transverse directions perpendicular to the longitudinal direction, the charging handle slot extending longitudinally, the spindle and grip extending transversely, and the first latch member on the bolt receiver being longitudinally forward of the second latch member in the bolt latching condition, the handle being unlatchable by slight longitudinally rearward movement of the grip which releases the second latch member from the bosses.

* * * * *